United States Patent [19]

Clum et al.

[11] 4,034,717

[45] July 12, 1977

[54] MULTI-SECTION HEAT EXCHANGER MEANS

[75] Inventors: David N. Clum; Fletcher O. Holt, both of Ponca City, Okla.

[73] Assignee: Heater Technology, Inc., Ponca City, Okla.

[21] Appl. No.: 612,244

[22] Filed: Sept. 10, 1975

[51] Int. Cl.[2] ..... F22B 21/24; F28F 9/22

[52] U.S. Cl. ..... 122/359; 165/145

[58] Field of Search ..... 122/359, 356, 24 UR; 110/173 R; 165/144, 145, 76, 78

[56] References Cited

U.S. PATENT DOCUMENTS

| | | | |
|---|---|---|---|
| 2,121,537 | 6/1938 | Coghill | 122/356 |
| 2,254,900 | 9/1941 | Lessman | 110/173 R |
| 2,514,535 | 7/1950 | Breukel | 122/356 |
| 2,617,372 | 11/1952 | O'Connor | 110/173 R |
| 3,713,424 | 1/1973 | Welz | 122/356 |

*Primary Examiner*—Carroll B. Dority, Jr.
*Assistant Examiner*—Theophil W. Streule, Jr.
*Attorney, Agent, or Firm*—F. Lindsey Scott

[57] ABSTRACT

An improved multi-section heat exchanger unit for use in combination with a radiant furnace unit or direct fired heaters which comprises a first heat exchange section having a plurality of bare heat exchange pipes positioned therein and in fluid communication with a first heat exchange fluid inlet and a first heat exchange fluid outlet to provide fluid flow through the bare pipes; and a second heat exchange section having a plurality of extended surface heat exchange tubes positioned therein in fluid communication with a second heat exchange fluid inlet being in fluid communication with the outlet of the first heat exchange section, the second heat exchange section being further characterized as having a gradually reduced internal cross section towards its upper portion so that the velocity of gas flow therethrough is maintained substantially constant.

In one embodiment a third heat exchange section having a plurality of extended surface heat exchange tubes positioned therein is provided wherein the tubes are in fluid communication with the tubes of the first and second heat exchange sections.

12 Claims, 7 Drawing Figures

MULTI-SECTION HEAT EXCHANGER MEANS

BACKGROUND OF THE INVENTION

This invention relates to direct fired heaters. In one aspect the present invention relates to heat exchanger means for such heaters. In yet another aspect the invention relates to a multi-section heat exchange means in which the lower section is provided with a plurality of bare tube heat exchange members and the second section is provided with a plurality of extended surface heat exchange members. In yet another aspect the invention relates to a multi-section heat exchange means wherein the second section is provided with a gradually reduced internal cross-section towards its upper portion so that the velocity of gas flow therethrough is substantially constant. In still another aspect the present invention relates to a multi-section heat exchange means having in addition to said lower section and said second section, at least one additional heat exchange section having a plurality of extended surface heat exchange members.

DISCUSSION OF THE PRIOR ART

A prior art search was conducted on the multi-section heat exchange means of the present invention. The references discovered are listed below in two catagories. Catagory A relates generally to process heaters and Catagory B relates generally to door seal means.

| U.S. Pat. No. | Title |
|---|---|
| 3,713,424 | Liquid Vaporizer |
| 3,227,143 | Packaged Direct Fired Heater |
| 2,625,916 | |
| 2,514,535 | Process for Heating Liquids In Tube Furnaces |
| 2,348,181 | Petroleum Heater |
| 2,124,291 | Method of Airconditioning |
| 2,094,911 | Method of Heating Fluids |
| 2,060,306 | Tube Still |
| 1,920,888 | Destructive Hydrogenation of Distillable Carbonaceaus Furnace |

Catagory B - Door Seal Means

| U.S. Pat. No. | Title |
|---|---|
| 2,502,219 | Refrigeration Cabinet with Condensation Preventing Means Radio Shielded Enclosures |
| 2,793,245 | Radio Shielded Enclosures |

Foreign Patents -

Italian Patent No. 495,238
French Patent No. 1,099,110

The references of Catagory A disclose various tube configurations which have been or could be readily employed in heat exchange units. U.S. Pat. No. 2,625,918 discloses a multi-zone fluid heating means wherein the cross-sections of the zones are varied. However, none of the references are believed to disclose the unique combinations of the multi-section heat exchange means of the present invention wherein the lower section contains close-spacing of bare tube heat exchange means and the second section contains extended surface heat exchange means in a housing of decreasing cross-section. Further, none of the references suggest or disclose the above combination of the first and second heat exchange means with at least one additional upper section containing extended surface heat exchange means.

The references designated Catagory B, relating to the door seal, are cited to show various means of sealing a door by employing angles to make the seal. However, the door sealing feature of the invention must be viewed in combination with the overall multi-section heat exchange means set forth hereinbefore.

SUMMARY OF THE INVENTION

According to the present invention an improved multi-section heat exchange unit for use in combination with a radiant furnace unit comprising direct fired heaters is provided. Broadly, the multi-section heat exchange unit comprises a first heat exchange housing having a fluid inlet and a fluid outlet, a plurality of heat exchange pipe means positioned within said housing and in fluid communication with a heat exchange fluid inlet and a heat exchange fluid outlet; a second heat exchange housing having a gradually reduced cross-sectional area to provide a substantially constant gas velocity therethrough, said second housing further having a fluid inlet and a fluid outlet, said fluid inlet of said second housing being in fluid communication with the fluid outlet of said first housing; a plurality of extended surface heat exchange tube means positioned within said second housing and in fluid communication with a heat exchange fluid inlet and a heat exchange fluid outlet of said second housing; and a stack means secured to the upwardly extending portion of said second housing.

Further according to the invention an improved multi-section heat exchanger unit is provided which includes at least one additional heat exchange housing positioned above said second heat exchange housing. Said additional heat exchange housing having a fluid inlet and a fluid outlet, said fluid inlet being in fluid communication with the fluid outlet of said second housing, and a plurality of extended surface heat exchange members positioned within said additional housing and in fluid communication with a heat exchange fluid inlet and a heat exchange fluid outlet.

OBJECTS OF THE INVENTION

An object of the invention is to provide an improved heat exchanger unit for a direct fired heater.

Another object of the invention is to provide an improved heat exchanger wherein fouling of the unit is controlled thereby requiring less maintenance.

Another object of the invention is to provide an efficient heat exchanger unit for direct fired heaters which can readily be modified in the plant without undue shut down of the unit or long delays.

These and other objects, advantages and features of the present invention will become apparent to those skilled in the art from a reading of the following detailed description.

BRIEF DESCRIPTION OF THE DRAWINGS

Drawings accompany and are a part of this disclosure. These drawings depict preferred specific embodiments of the improved multi-section heat exchanger unit of the present invention.

In the following description of the drawings the same reference numerals will be used to indicate the same or similar parts.

DETAILED DESCRIPTION OF THE INVENTION

Figure 1:
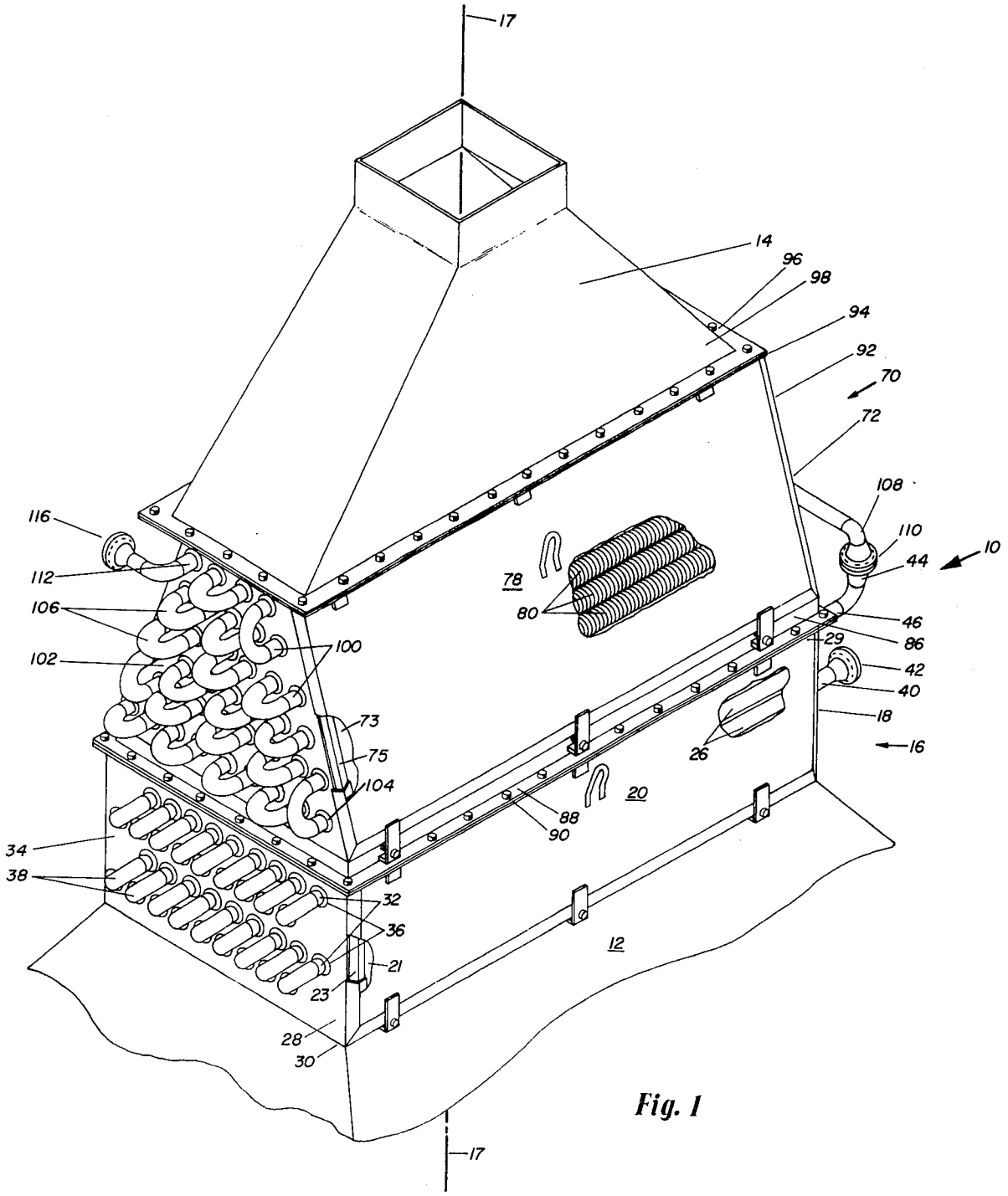
FIG. 1 is a partially broken isometric view of an embodiment of the multi-section heat exchanger unit of the present invention.

With reference to the drawings, and particularly to FIG. 1, a multi-section heat exchanger 10 is shown positioned on a direct fired furnace 12. Heat exchanger 10 is also fitted with a stack means 14. Heat exchanger means 10 is a multi-section unit having a vertical axis 17, a first heat exchange section 16 and a second heat exchange section 70.

First heat exchange section 16 comprises a generally rectangular housing means 18, a door means 20, heated gas inlet means 22, (shown in FIG. 2) heated gas outlet means 24 (shown in FIG. 2) and heat exchange pipes 26. A lower portion 28 of housing means 18 is sealingly joined onto upper portion 30 of furnace 12 by means known to those skilled in the art, such as welding, bolting, clamping or the like.

Heat exchange pipes 26 comprise a plurality of bare heat exchange pipes positioned within housing means 18 so that end portions 32 of bare pipes 26 extend through end portions 34 of housing means 18. A fluid tight seal 36 is provided between housing means 18 and pipes 26. Pipes 26 are inconnected by coupling members 38 to provide fluid communication through pipes 26. A lower terminal pipe 40 is connected to a heat exchange fluid outlet 42. A heat exchange inlet 44 is connected to an inlet pipe 46 to provide a fluid passageway through pipes 26. The term "bare pipe" as used herein is to be understood to mean pipes having no extended surface, eg. smooth surface pipe.

Figure 2:
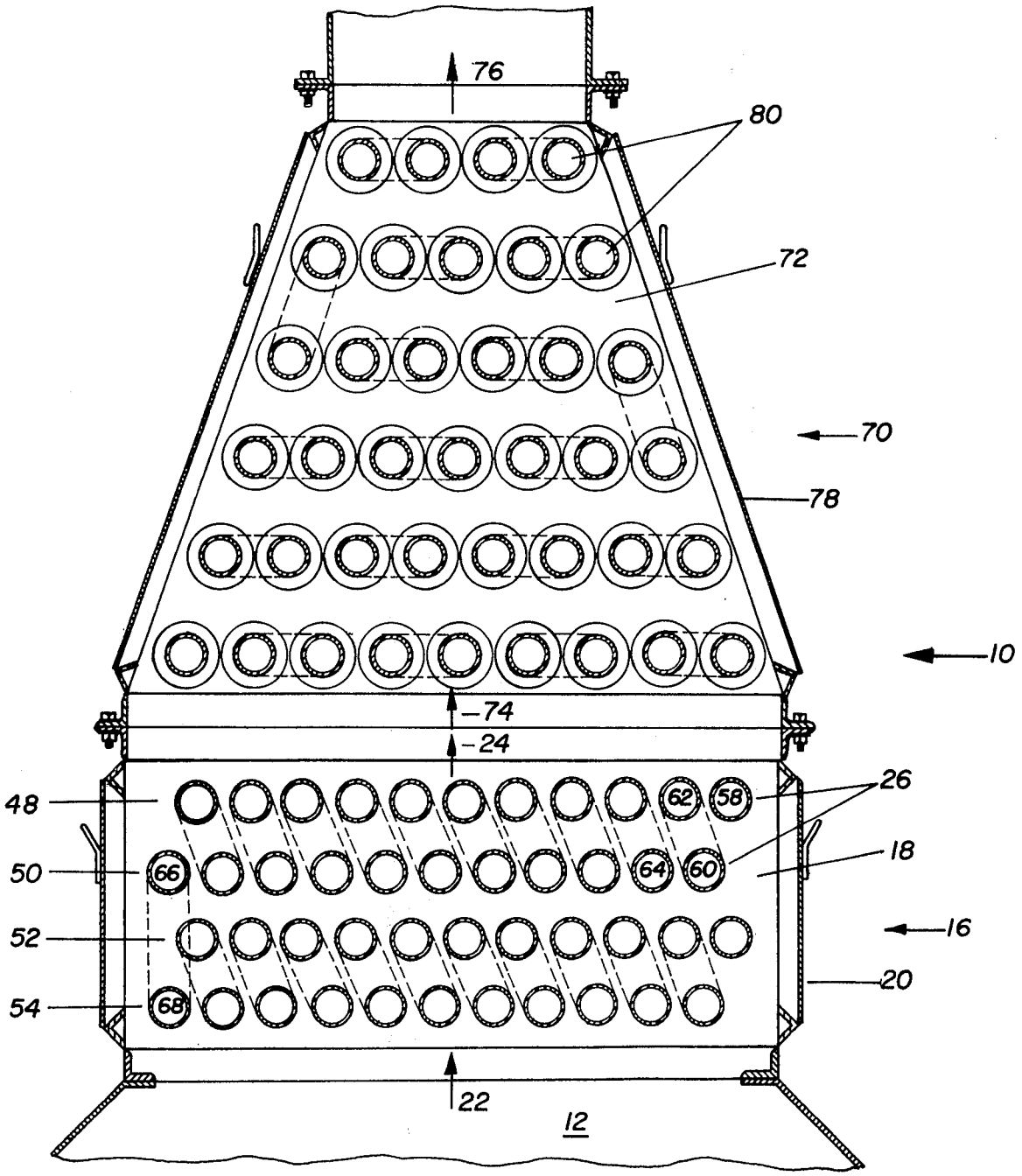
FIG. 2 is a cross-sectional view of the heat exchanger means of FIG. 1.

Referring now to FIG. 2 in conjunction with FIG. 1, pipes 26 are positioned within housing means 18 in parallel rows 48, 50, 52 and 54 in such a manner that pipes 26 in alternate rows, i.e., rows 48 and 52, are substantially between pipes 26 in adjacent rows, i.e., rows 50 and 54. By employing such a spacing concept a close spacing of pipes 26 is obtained which results in a more efficient heat transfer in first heat exchange section 16. Further, each pipe 26 is connected, by coupling members 38 to another vertically displaced pipe 26 except for lower terminal heat transfer pipe 40 which is connected to heat exchange fluid outlet means 42. In other words, heat transfer pipes 26 are connected in a row-to-row fluid flow circuitry rather than a lateral row fluid flow circuitry. More specifically the heat exchange fluid flow is exemplified by the following example. With respect to FIG. 2 specifically fluid passes through pipes 26 in the following sequence. Fluid flows through pipe 58 in row 48, then through pipe 60 in row 50, then through pipe 62 in row 48, then through pipe 64 in row 50 and the like with the fluid flowing through pipe 66 being passed to pipe 68 in row 54 where a similar sequence is repeated through rows 52 and 54. Obviously a plurality of rows can be used. By employing such a flow pattern through heat transfer pipes 26 fluid flow through the heat transfer pipes 26 is first through a first tube in one row, then through a second tube in an adjacent row, and then back through a third tube in the initial row, and the like so that the heat exchange efficiency and capacity of first heat exchange section 16 is greatly improved.

Figure 4:
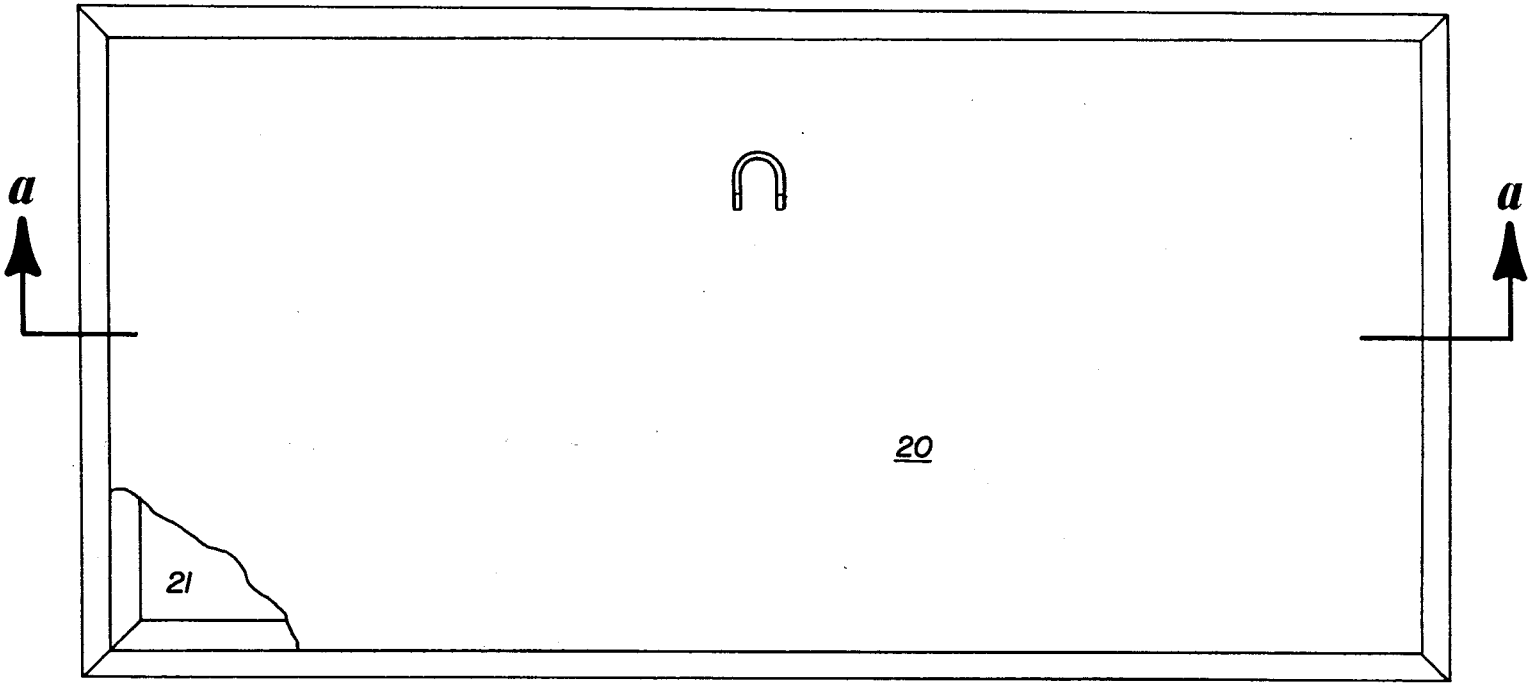
FIG. 4 is an enlarged, partially broken, plane view depicting the door means of the first heat exchange section of FIGS. 1 and 3.
Figure 5:
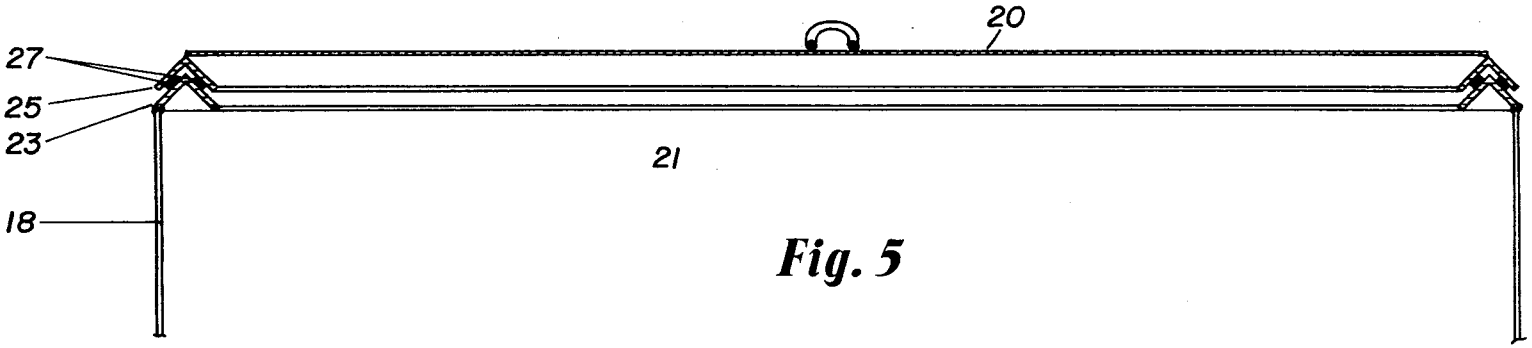
FIG. 5 is a sectional view of the door means of FIG. 4 taken along the line *a—a*.

Housing means 18 is provided with door means 20 so that the operator of exchanger 10 can have ready access to the interior of first heat exchange section 16 for cleaning and the like when exchanger 10 is not in operation. In order to fully describe door means 20 reference will be made to FIGS. 4, and 5 in conjunction with FIG. 1. Housing means 18 is provided with an opening 21 having reinforcing members 23 secured to housing means 18 around opening 21 so that door means 20 can be positioned thereon and secured to reinforcing members 23 and thus housing means 18. A fluid tight seal is thus provided when door means 20 is secured to reinforcing members 23 and thus housing means 18 by any suitable means known to those skilled in the art such as by clamps, bolts, and the like (shown in FIG. 1 as unnumbered retaining clamp members). Door means 20 is preferably provided with reinforcing members 25 around its periphery which cooperate with reinforcing member 23 of housing means 18. While any suitable materials can be used as reinforcing member 23 and 25, we have found that by employing angle shaped reinforcing materials wherein the angles are inverted, such as angle iron, seals can be made on both sides or extensions of the reinforcing materials and thus an improved seal between same is provided. Further, use of angle shaped reinforcing materials assists the operator in positioning the door on said housing. In addition, it is often desirable to position gasket means 27 between reinforcing members 23 and 25 to assist in the sealing of same.

Referring again to FIG. 1, second heat exchange section 70 comprises housing means 72, a heated gas inlet means 74, (shown in FIG. 2), a heated gas outlet means 76, (shown in FIG. 2), a door means 78 and heat transfer tubes 80. Housing means 72 is provided with a gradually reduced internal cross-section towards its upper portion so that the velocity of gas flow therethrough is maintained substantially constant. Typical geometric configurations which can readily be used for housing means 72 are a trapazoidal, pyramidal, conical and the like. A lower portion 86 of housing means 72 is sealingly affixed to an upwardly extending edge portion 29 of housing means 18 of the first heat exchange section 16 by means known to those skilled in the art. For instance, housing means 72 and housing means 18 can be joined by the use of gasket members (now shown) cooperating and positioned between flange 88 on housing means 72 and flange 90 on housing means 18 and thereafter bolting or clamping the flanges together thus sealing the housing means. Upper portion 92 of housing means 72 is also provided with flange 94 which cooperates with flange 96 in a lower portion 98 of stack 14 so that housing means 72 and stack means 14 can be sealing joined. Gaskets (not shown) are desirably positioned between flanges 94 and 96 on housing means 72 and stack means 14, respectively.

Heat transfer tubes 80 comprise a plurality of extended surface tubes positioned within housing means 72 so that end portions 100 of tubes 80 extend through end portions 102 of housing means 72. A fluid tight seal 104 is provided between housing means 72 and end portions 100 of tubes 80 where tubes 80 extend through the end portions 102 of housing means 72. End portions 100 of heat transfer tubes 80 are interconnected via coupling members 106 to provide fluid communication between tubes 80. An end portion of a lower, terminal tube 108 is connected to fluid heat exchange outlet means 110 which in turn is coupled to fluid heat exchange inlet means 44 of housing means 18 of first heat exchange section 16 to thus provide fluid communication between tubes 80 and pipes 26. An end portion 112 of the upper positioned, initial heat transfer tube 80 is connected to heat exchange fluid inlet means 116 which is in turn connected to a source (not shown) of heat exchange fluid. The term "extended surface tubes" as used herein is to be understood to mean finned tubes, studded tubes, and the like which have been modified to increase the external surface area.

Referring now to FIG. 2, in conjunction with FIG. 1, heat transfer tubes 80 are positioned within housing means 72 in parallel rows in such a manner that the heat transfer tubes 80 are positioned substantially between the heat transfer tubes in alternate rows. Further, each heat transfer tube is connected to the adjacent tube lying in the same horizontal row by coupling members 106 except for the end positioned tube in the row and in the row positioned immediately below. In other words, heat transfer tubes 80 are connected in a lateral row fluid flow circuitry.

Housing means 72 is provided with a door means 78 so that the operator of the unit can have ready access to heat transfer tubes 80 when the unit is not in operation.

Figure 6:
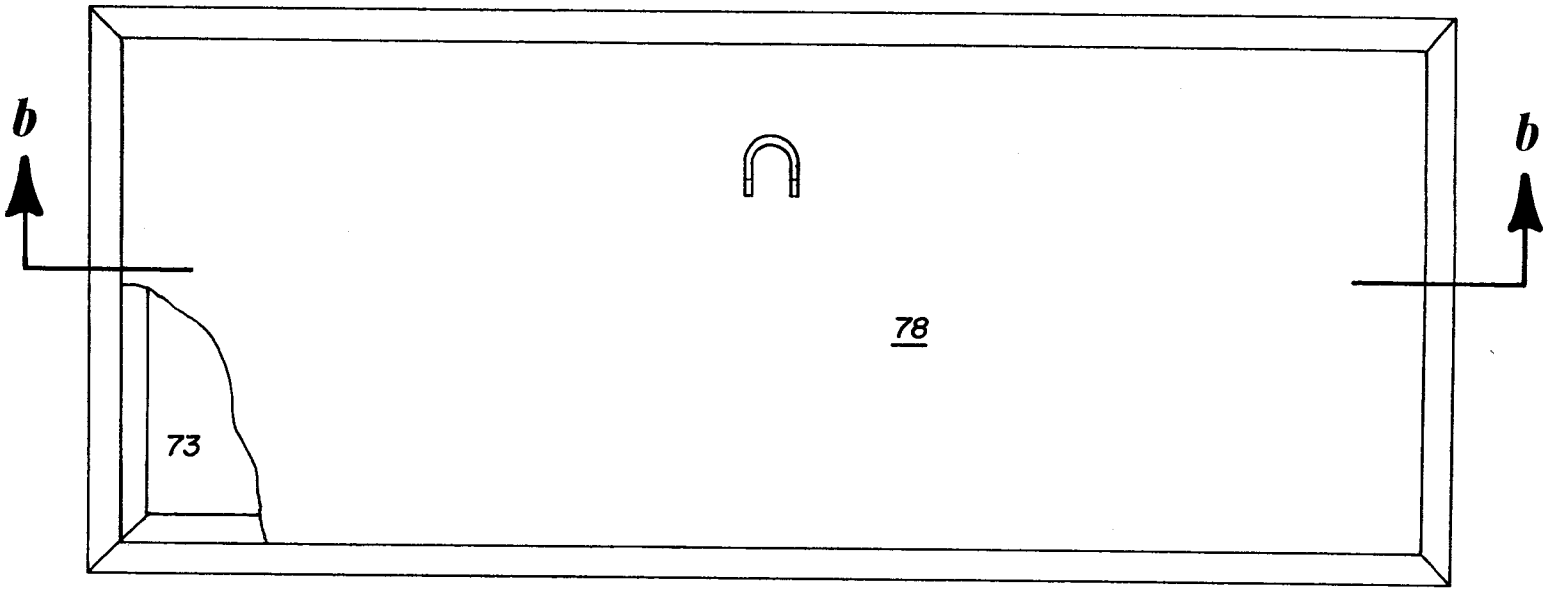
FIG. 6 is an enlarged, partially broken plane view depicting the door means of the second heat exchange section of FIGS. 1 and 3.
Figure 7:
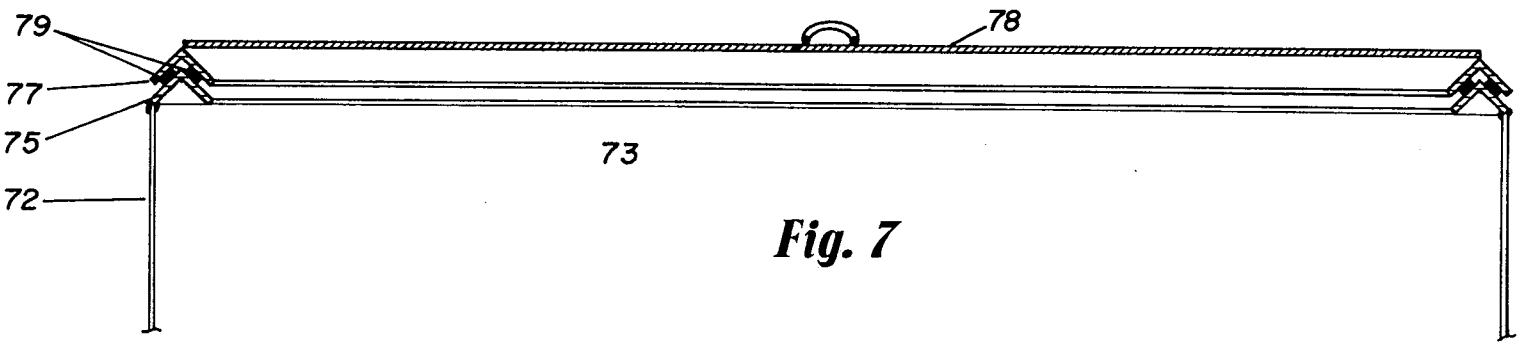
FIG. 7 is a sectional view of the door means of FIG. 5 taken along the line *b—b*.

In order to fully describe door means 78 reference will be made to FIGS. 6 and 7 in conjunction with FIG. 1. Housing means 72 is provided with an opening 73 having reinforcing members 75 secured to housing means 72 around opening 75 so that door means 78 can be positioned thereon and secured to reinforcing member 75 and thus housing means 72. A fluid tight seal is provided when door means 78 is secured to reinforcing members 75 by any suitable means known to those skilled in the art such as clamps, bolts and the like. Door means 78 is preferably provided with reinforcing members 77 secured to and positioned around its perifery which cooperate with reinforcing members 75 of housing means 72. As previously stated, it is preferred that the reinforcing members 75 and 77 be angle shaped and that they be positioned to form inverted angles. Such provides an improved seal while assisting in the alignment of the door when same is being placed into position. Further gasket means 79 is positioned between reinforcing members 75 and 77 to assist in sealing same.

Figure 3:
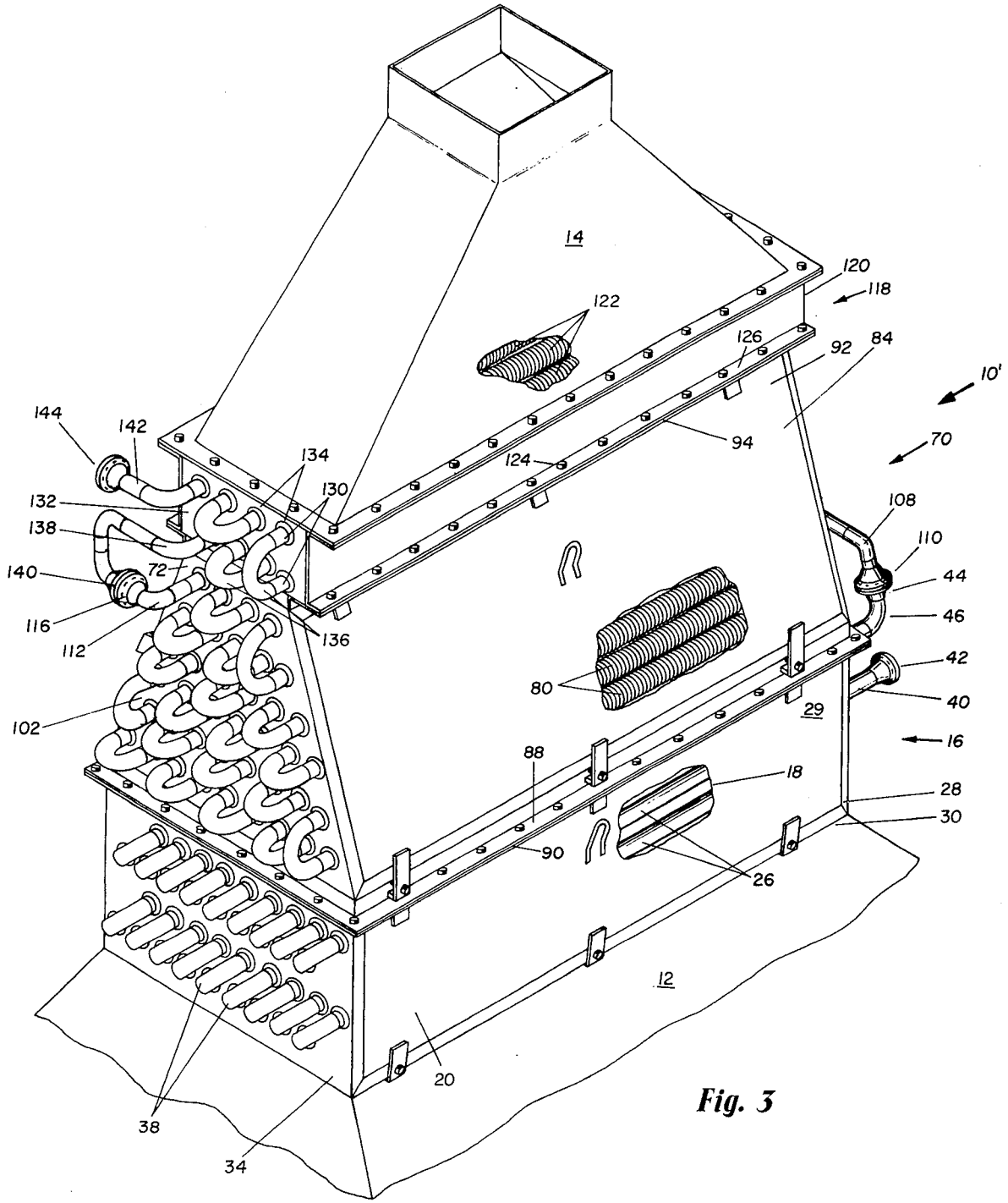
FIG. 3 is a partially broken isometric view of a further embodiment of the multi-section heat exchanger unit of the invention.

Referring now to FIG. 3, a second embodiment of heat exchanger means 10' of the present invention is shown. In this embodiment heat exchange means 10' is a multi-section heat exchanger positioned on a direct fired furnace 12. Heat exchanger means 10' is also fitted with a stack means 14. Heat exchanger means 10' is a multi-section unit having a first heat exchange section 16, a second heat exchange section 70, and a third heat exchange section 118. First heat exchange 16 and second heat exchange section 70 have been discussed in detail with reference to FIG. 1 and FIG. 2. Thus, they are incorporated by reference with the discussion of third heat exchange section 118 for the sake of clarity.

Third heat exchange section 118 comprises housing means 120, shown as a rectangular housing means, and heat transfer conduits 122. A lower portion 124 of housing means 120 is provided with a flange 126 which cooperates with flange 94 on upper portion 92 of means 72 so that housing means 120 of third heat exchange section 118 can be sealingly joined to housing means 72 of second heat exchange section 70. Gasket means (not shown) can be employed between flange 94 and flange 126 to provide a fluid tight seal therebetween. Any suitable means can be employed to secure flange means 94 and 126, such as bolts, clamps and the like.

Heat transfer conduits 122 comprise a plurality of extended surface tubes and/or pipes positioned within the housing means 120 so that end portions 130 of such tubes, which do not have extended surfaces, extend through end portions 132 of housing means 120. A fluid tight seal 134 is provided between end portions 132 of housing 120 and end portion 130 of conduits 122. End portions 130 of heat transfer conduits 122 are interconnected by coupling members 136 so as to provide heat exchange fluid flow through heat transfer conduits 122. An end portion 138 of a lower terminal heat transfer conduit 122 is connected to heat exchange fluid outlet means 140 which in turn is coupled with heat exchange fluid inlet means 116 of housing means 72 of second heat exchange section 70. An end portion 142 of an upper positioned initial heat transfer conduit 122 is connected to a heat exchange fluid inlet means 144 and thus to a source (not shown) of the heat exchange fluid. Heat exchange fluid flow through conduits 122 of third section 118 is as previously discussed in the description of heat transfer tubes 80 in second heat exchange section 70. It should be noted that while this embodiment has been illustrated with three heat exchange sections, one can readily employ additional heat exchange sections if desired. Further, it should be apparent that housing means 120 is provided with heated gas inlet and outlet means similar to housing means 18 of first heat exchange section 16 so that gas flow, such as flue gas, is upward from direct fired furnace 12 through first heat exchange section 16, through second heat exchange section 70, then through third heat exchange section 118 and lastly, through stack means 14. Thus, the heat exchange means of the present invention can readily be tailored to the users particular needs.

OPERATION

To further illustrate the present invention a simplified operation employing the means shown in FIG. 3 will be discussed. Flue gas, exiting from direct fired furnace 12 flows upwardly through multi-section section heat exchanger 10'. The flue gas, which is at its highest temperature as it exits furnace 12 is passed into first heat exchange section 16. The flue gas flows upwardly through housing means 18 and around closely spaced heat exchange bare pipes 26. After passing through said first heat exchange section the flue gas, which has been cooled to the desired temperature, is passed into second heat exchange section 70. The flue gas flows upwardly through housing means 72 and around the extended surface tubes of heat transfer tubes 80. After passage through said second heat exchange section the flue gas is passed into third heat exchange section 118. The gas flow through housing means 120 of said third section is again in an upwardly direction and around the extended surface conduits of heat transfer conduits 122. The cooled flue gas then exits housing means 120 and passes through stack 14.

Several unique features are obtained by employing the improved multi-section heat exchange means of the present invention. First, by employing second heat exchange section 70 having housing means 72 in which the internal cross-section is gradually reduced the flue gas velocity through said second heat exchange section is maintained at approximately the same velocity as when it entered first heat exchange section 16.

The second unique feature of the present invention is that most of the fouling from crude oil and other similar fuels can be controlled so that same occurs in first exchange section 16, e.g. the bare pipe section. This is accomplished by the close spacing of heat exchange pipes 26, made possible by row to row fluid flow of the heat exchange fluid through said heat exchange pipes. Such concept allows the unit to make more efficient use of bare tube surface and provide sufficient heat transfer to reduce the temperature of the flue gas, as it exits first heat exchange section 16, to the temperature required to assure deposition of metallic salts, free sulfur, vanadium, unburned fuel and the like. The importance of controlling the fouling in the first section is that since bare pipes are employed, such are more easily cleaned than extended surface conduits or pipes.

A third feature lies in the use of third heat exchange section 118. By employing third heat exchange section 118 one is provided with a readily replaceable unit which provides an efficient unit if cold inlets or cold feeds are desired to increase the efficiency of a process. The unit being readily replaceable or disposable is important when processing high sulfur content fuels and to control the dew point corrosion in such section.

It should further be noted that the heat transfer fluid flow is counter flow with respect to the flow of the flue gas. This means that the temperatures of the fluid through the heat transfer means is highest when in contact with the warmest flue gas and thus coldest when in contact with the coolest flue gas. It should be noted that other features and advantages of the present invention will be apparent to those skilled in the art and the features set forth hereinbefore are not to be viewed as limitations of the invention.

While the present invention has been described with reference to specific embodiments it is to be understood that certain modification of the multisection heat exchanger means of the present invention can be made without departing from the scope and spirit of same. For example, if one desires one can seal the end portions of the bare pipes extending through the end portions of the housing means of the first heat exchange section by employing a covering means rather than the sealing means depicted. Likewise, other sealing means can be employed, which are well known to those skilled in the art for sealing any or all of the pipes, conduits and the like extending through the housing.

Having described the invention, we claim:

1. A multi-section heat exchanger unit for recovering heat values from a heated gas stream, said unit including:

a. a first heat exchange section, said first heat exchange section comprising a first outer housing section having a heated gas inlet, a heated gas outlet, and a plurality of heat exchange pipe means, said heat exchange pipe means being positioned through said first outer housing section and in fluid communication with a first heat exchange fluid inlet and a first heat exchange fluid outlet to provide heat exchange fluid flow through said heat exchange pipe means and said first heat exchange section, said heat exchange pipe means comprising pipes positioned in a plurality of substantially parallel rows, said rows being substantially perpendicular to a vertical axis of said unit with alternate rows being positioned so that the pipes in alternate rows are positioned substantially between the pipes in adjacent rows, said pipes being joined at their ends by means for directing said heat exchange fluid flow through said pipes so that said fluid flows sequentially through a first pipe positioned in a first row, through a second pipe positioned in a second adjacent row, through a third pipe positioned in said first row in a repeating sequence through substantially all of said pipes in said first and second rows and then through a third row and a fourth row and subsequent rows in substantially the same repeating sequence so that said heat exchange fluid flows sequentially through substantially all of the pipes in said first heat transfer section to provide an improved first heat exchange section efficiency;

b. a second heat exchange section comprising a second outer housing section having a heated gas inlet, a heated gas outlet, said heated gas inlet of said second heat exchange section being in fluid communication with said heated gas outlet of said first heat exchange section, said second section including a plurality of heat exchange tube means, said tube means being positioned through said second outer housing section and in fluid communication with a second heat exchange fluid inlet and a second heat exchange fluid outlet to provide heat exchange fluid flow through said tube means and said second heat exchange section, said second heat exchange fluid outlet being in fluid communication with said first heat exchange fluid inlet of said first heat exchange section, said second outer housing section being shaped to enclose an internal cross-sectional area, which decreases between its heated gas inlet and its heated gas outlet so that said area is at a maximum at its inlet.

2. The heat exchanger unit of claim 1 wherein said heat exchange pipe means comprise bare pipes and wherein said heat exchange tube means comprise tubes having an extended heat exchange surface area.

3. The heat exchanger unit of claim 2 wherein said tubes of said second heat exchange section are in substantially parallel rows, said rows being substantially perpendicular to a vertical axis of said unit with alternate rows being positioned so that tubes in alternate rows are positioned substantially between the tubes in adjacent rows, said heat exchanger fluid flow through said tubes being sequentially through said tubes in lateral row fluid flow circuitry commencing with the upwardly positioned row of tubes.

4. The heat exchanger unit of claim 3 wherein said second outer wall section comprises a truncated pyramid.

5. The heat exchange unit of claim 4 wherein said first outer housing of said first heat exchange section includes a removable door means, said door means being adapted to sealingly mate with an opening in said housing to seal said opening in said housing whereby said first section can be serviced and cleaned, said door including first angular members positioned around the periphery of said door and adapted to matingly join with second angular members positioned about the periphery of said opening so that said door is readily positioned by mating first and second angular members to sealingly position said door over said opening.

6. The heat exchange unit of claim 5 wherein said second outer housing of said second heat exchange section includes a removable door means, said door means being adapted to sealingly mate with an opening in said housing to seal said opening in said housing whereby said first section can be serviced and cleaned, said door including first angular members positioned around the periphery of said door and adapted to matingly join with second angular members positioned about the periphery of said opening so that said door is readily positioned by mating said first and second angular members to sealingly position said door over said opening.

7. The heat exchanger unit of claim 3 wherein said multisection heat exchanger means includes at least one third heat exchanger section, said third heat exchanger section comprising a third outer housing section having a heated gas inlet and a heated gas outlet, said heated gas inlet being in fluid communication with said heated gas outlet of said second outer housing section, said third section including a plurality of heat exchange conduit means, said conduit means being positioned through said third outer housing section and in fluid communication with a third heat exchange fluid inlet and a third heat exchange fluid outlet, said third heat exchange fluid outlet being in fluid communication with said second heated exchange inlet of said second heat exchange section.

8. The heat exchanger unit of claim 7 wherein said tubular members of said third heat exchange section are in substantially parallel rows, said rows being substantially perpendicular to a vertical axis of said unit with alternate rows being positioned so that tubular members in alternate rows are positioned substantially between tubular members in adjacent rows, said heat exchanger fluid flow through said tubular members being sequentially through said tubes in a lateral row fluid flow circuitry commencing with the upwardly positioned row of tubular members.

9. The heat exchanger unit of claim 8 wherein said conduit means comprise tubular members having an extended heat exchange surface area.

10. In a multi-section heat exchanger unit for recovering heat values from a heated gas stream, said unit including:

a. a first heat exchange section, said first heat exchange section comprising a first outer housing section having a heated gas inlet, a heated gas outlet and a plurality of heat exchange pipe means, said heat exchange pipe means being positioned through said first outer housing section and in fluid communication with a first heat exchange fluid inlet and a first heat exchange fluid outlet to provide heat exchange fluid flow through said heat exchange pipe means and said first heat exchange section, said heat exchange pipe means comprising pipes positioned in a plurality of substantially parallel rows, said rows being substantially perpendicular to a vertical axis of said unit with alternate rows being positioned so that the pipes in alternate rows are positioned substantially between the pipes in adjacent rows;

b. a second heat exchange section comprising second outer housing section having a heated gas inlet and a heated gas outlet, said heated gas inlet of said second heat exchange section being in fluid communication with said heated gas outlet of said first heat exchange section, said second section including a plurality of heat exchange tube means, said tube means being positioned through said second outer housing section and in fluid communication with a second heat exchange fluid inlet and a second heat exchange fluid outlet to provide heat exchange fluid flow through said tube means and said second heat exchange section, said second heat exchange fluid outlet being in fluid communication with said first heat exchange fluid inlet of said first heat exchange section, said second outer housing section being shaped to enclose an internal cross-sectional area, which decreases between its heated gas inlet and its heated gas outlet so that said area is at a maximum at its inlet, the improvement comprising joining said pipes at their ends by means for directing said heat exchange fluid flow through said pipes so that said heat exchange fluid flows sequentially through a first pipe positioned in a first row, through a second pipe positioned in a second adjacent row, through a third pipe positioned in said first row in a repeating sequence through substantially all of said pipes in said first and second rows and then through a third row and a fourth row and subsequent rows in substantially the same repeating sequence so that said heat exchange fluid flows sequentially through substantially all of the pipes in said first heat transfer section to provide an improved first heat transfer section efficiency.

11. The improvement of claim 10 wherein said heated gas stream is produced by the combustion of fouling fuels and contains fouling contaminants such as metallic salts, free sulfur, vanadium, and unburned fuel and wherein said pipes of (a) are present in a number sufficient to result in reducing the temperature of said heated gas stream in said first heat exchange section to the temperature required to assure deposition of said fouling contaminants in said first heat exchange section.

12. In a multi-section heat exchanger unit for recovering heat values from a heated gas stream, said unit including:

a. a first heat exchange section, said first heat exchange section comprising a first outer housing section having a heated gas inlet, a heated gas outlet and a plurality of heat exchange pipe means, said heat exchange pipe means being positioned through said first outer housing section and in fluid communication with a first heat exchange fluid inlet and a first heat exchange fluid outlet to provide heat exchange fluid flow through said heat exchange pipe means and said first heat exchange section, said heat exchange pipe means comprising pipes positioned in a plurality of substantially parallel rows, said rows being substantially perpendicular to a vertical axis of said unit with alternate rows being positioned so that the pipes in alternate rows are positioned substantially between the pipes in adjacent rows;

b. a second heat exchange section comprising a second outer housing section having a heated gas inlet and a heated gas outlet, said heated gas inlet of said second heat exchange section being in fluid communication with said heated gas outlet of said first heat exchange section, said second section including a plurality of heat exchange tube means, said tube means being positioned through said second outer housing section and in fluid communication with a second heat exchange fluid inlet and a second heat exchange fluid outlet to provide heat exchange fluid flow through said tube means and said second heat exchange section, said second heat exchange fluid outlet being in fluid communication with said first heat exchange fluid inlet of said first heat exchange section, said second outer housing section being shaped to enclose an internal cross-sectional area, which decreases between its heated gas inlet and its heated gas outlet so that said area is at a maximum at its inlet, at least one of said heat exchange section and said second heat exchange section including a removable door means, the improvement comprising first angular members positioned about said door and adapted to matingly join with second angular members secured to the periphery of an opening positioned in a side of said housing section and adapted to receive said door so that said door is readily positioned by mating said first and second angular members to sealingly position said door over said opening.

* * * * *